US007396188B2

(12) United States Patent
Brochu et al.

(10) Patent No.: US 7,396,188 B2
(45) Date of Patent: Jul. 8, 2008

(54) LEACHING CHAMBER HAVING VARYING SLOTTED WALL THICKNESS

(75) Inventors: Ronald P. Brochu, Westbrook, CT (US); James J. Burnes, Deep River, CT (US); John R. Battye, Lebanon, CT (US); Roy E. Moore, Jr., Killingworth, CT (US); Bryan A. Coppes, Old Saybrook, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 0 days.

(21) Appl. No.: 11/717,551

(22) Filed: Mar. 12, 2007

(65) Prior Publication Data

US 2007/0172314 A1 Jul. 26, 2007

Related U.S. Application Data

(62) Division of application No. 10/677,938, filed on Oct. 1, 2003, now Pat. No. 7,189,027.

(51) Int. Cl.
*E02B 11/00* (2006.01)

(52) U.S. Cl. ..... 405/49; 405/43; 138/173

(58) Field of Classification Search ..... 405/36, 405/43–46, 48, 49; 138/105, 121, 128, 173
See application file for complete search history.

(56) References Cited

U.S. PATENT DOCUMENTS 4,759,661 A * 7/1988 Nichols et al. ..... 405/48
6,361,248 B1 * 3/2002 Maestro ..... 405/49

* cited by examiner

*Primary Examiner*—Tara L. Mayo
(74) *Attorney, Agent, or Firm*—C Nessler

(57) ABSTRACT

A continuous curve arch shape cross section leaching chamber made of molded thermoplastic has closely spaced corrugations and sidewalls, portions of which are perforated with horizontal slots. Either or both of the slot height and the local wall thickness which defines the slots may vary with slot elevation from the base, so that a perforated sidewall configuration is achieved which resists entry of surrounding soil. In one embodiment, the slotted sidewall has slots with all the same slot openings and the wall thickness decreases with elevation.

22 Claims, 8 Drawing Sheets

LEACHING CHAMBER HAVING VARYING SLOTTED WALL THICKNESS

This application is a divisional-continuation of patent application Ser. No. 10/677,938, filed Oct. 1, 2003 now U.S. Pat. No. 7,189,027.

TECHNICAL FIELD

The present invention relates to leaching chambers, for receiving and dispersing wastewater when buried in soil.

BACKGROUND

Most prior-art thermoplastic leaching chambers have a number of design characteristics in common, both for functional and manufacturing reasons. Typically, chambers have slotted, inwardly sloped, planar sidewalls, which run up to a curved arch top. They have arch-shape cross sections, and wide peak and valley corrugations running up over the arch. For example, see Pat. No. 5,017,041 of Nichols et al.

Slotted sidewall perforations provide open area, for infiltration of wastewater through the sidewall into the soil surrounding the chamber. Prior art chambers have relatively few corrugations, typically about one peak per foot, because that makes more area available for slot opening in peaks and in valleys which are usually the only areas with perforations. In use, leaching chambers must resist the loads from both overlying soil, and from vehicles and other things traveling along the soil surface, as well as lateral load of soil on the sidewall. Since the slots or other perforations weaken the sidewall, the sidewall is substantially thickened in vicinity of the slots, and ribs and other structures are provided for strength.

During use soil should not enter the chamber through the sidewall perforations. Some prior art devices simply have holes in thin walls, and geotextile, or porous fabric, laid over the sidewall prevents entry of soil. But that approach is undesired by many persons, because of cost and nuisance. The present invention is concerned with the class of chambers, which have perforations that are intended to inhibit soil entry by shape, without use of geotextile. The intent is that dimensions of the perforations, typically horizontal slots, themselves inhibit soil entry. Commonly, the portions of sidewall which are just above and below any slot are referred to as louvers. Louvers project from the basic sidewall and make slots deep compared to what their depth would be otherwise. But doing that increases wall thickness, which increases chamber weight and cost. In a typical chamber, the through-wall length of a slot might be increased to about 0.5 inch (1.27 cm) by louvers, where the basic wall thickness of the chamber elsewhere is about 0.13 inch (0.33 cm). However, louvering increases the amount of material in a chamber, and requires substantial attention to get proper feeding during molding.

Leaching chambers must be reliably and economically fabricated, and nested for shipment. When injection molding is used, feeding of different regions, particularly louvers near slots, is accomplished by flowing plastic along ribs, which also strengthen the structure. Ribs usually run lengthwise and transversely on the interior and or exterior of a chamber. However, the presence of ribs lessens the ability to stack chambers in closely nested fashion. See U.S. Pat. No. 5,511,903 for information relating to chamber parameters and nesting. The result of the various trade-offs has been that a typical commercial slotted wall leaching chamber made of high density polyethylene is about 6 feet (183 cm) long, about 3 feet (92 cm) in width at the base, about 12-18 inch (30-46 cm) high. And it has five or six peak corrugations, louvers, ribs, and weighs 25-40 pounds (11.4-18 kg) or more.

The prior art chambers work well and have enjoyed commercial success. But there is a constant aim to improve chambers, so effectiveness or performance can be increased for the same cost, or so that cost can be reduced while maintaining effectiveness. One of the ways to reduce costs is to reduce the weight of plastic in a given size chamber, thereby reducing material and manufacturing cycle costs. Progress has been obtained in some prior art chambers by using gas assisted injection molding, wherein some interior portions are made hollow. See U.S. Pat. No. 5,716,163. Further improvements are desired.

SUMMARY

An object of the invention is to provide a leaching chamber which has reduced cost per unit of leaching area. Another object is to provide a chamber which has slots or other perforations in the sidewall, but which does not use heavy louvers to resist inward migration of soil. A further object is to provide a continuous curve arch shape leaching chamber with perforations which have substantially uniform Soil Threshold Angles, regardless of perforation elevation from the base. A still further object is to provide chambers which are lighter, stronger and easier to handle, and which nest well for shipment.

In accord with the invention, a continuous curve arch shape chamber has a sidewall of substantially constant thickness. Perforations, such as slots, are run on a downward slope at angle SA, from the interior to the exterior of the chamber. In this embodiment, the vertical height of perforation opening increases with perforation distance from the base. Preferably, the slots all have the same Soil Threshold Angle (STA). STA is a geometric measure of the ability of a slot to inhibit soil infiltration into the chamber during use. STA is preferably less than RA, the repose angle of soil that surrounds the chamber. STA is preferably less than 30 degrees, more preferably 26 degrees or less.

In further accord with the invention, another embodiment of a continuous curve arch shape leaching chamber has a sidewall with perforations, such as slots, which have substantially constant height from one slot to the next; and, sidewall thickness decreases with elevation. The perforations run downwardly toward the exterior, as in the foregoing embodiment and preferably all have the same Soil Threshold Angle (STA).

In still further accord with the invention, combining the two foregoing features, another curved arch shape cross section leaching chamber has a wall thickness which decreases with elevation, together with slot height which increases with elevation, preferably so that STA for all slots is above a critical threshold, preferably greater than RA, and preferably 26 degrees or less.

In a preferred embodiment in accord with the invention, a chamber has a continuous curve arch shape, downward sloping perforations, preferably substantially identical inwardly flaring slots, and perforation height increases with elevation. The slot interior and exterior edges are rounded, which has the effect of significantly increasing STA for slots at high elevation, compared to what STA would otherwise be. Thus, in the invention, chamber sidewall is thicker at higher elevation than it is near the base, to the extent that STA for all the slots may be equal or less than a critical STA, for instance 26 degrees.

In still further accord with the invention, a continuous curve leaching chamber is made of polypropylene and has peak and valley corrugations on a pitch which is 6-7 inch (15-18 cm), preferably about 6.5 inch (16.5 cm). That compares with the about 12 inch (30 cm) pitch common in the prior art. Sidewall slots sidewall slope downwardly, preferably at about 12 degrees from horizontal, and flare inwardly with an about 12 degree included angle.

In further accord with the invention, an arch shape cross section corrugated leaching chamber is made of a thermoplastic having a density in the range of 0.033-0.034 lb per cu inch, for instance high density polyethylene or polypropylene. The chamber has a base width of about 34 inch (86 cm). The sidewall is slotted but free of prior art type thick or heavy louvers. The corrugated body is smooth and free of ribs. The chamber wall in regions away from the slotted sidewall is substantially thinner than at the slotted sidewall. The chamber has a leaching area to weight ratio of greater than about 100 square inch per pound (1.45 sq meter per kilogram), preferably about 125 square inch per pound (1.81 sq meter per kilogram). The chamber has a leaching area per unit length of at least 30 square inch per inch (193 sq cm). The chamber weighs less than about 4 pounds per foot (6 kg per meter) of chamber length, preferably less than about 3 pounds per foot (4.5 kg per meter). An exemplary chamber has in is about 4 ft (122 cm) long, and weighs about 12 pounds.

In still further accord with the invention, the thickness of the perforated chamber sidewall, namely, the peaks and valleys of the corrugated sidewall, is less than about 2 times the thickness of the rest of the chamber wall, called the basic thickness, which is unperforated. The walls are free of what have been characterized as louvers in the past, and substantially thinner, while still obtaining a Soil Threshold Angle in the perforations which is at least comparable to the prior art chambers and which inhibits entry of soil during use.

Chambers made in accord with the invention have leaching area per unit length which is in the range of the prior art chambers. They have strength in resisting loads imparted through the soil which is at least comparable to prior art chambers. Yet they have dramatically reduced weight per unit length and leaching area per pound of material. Thus, they are much more efficient in use of material. They are easy to handle and economic to make.

The foregoing and other objects, features and advantages of the invention will become more apparent from the following description of preferred embodiments and accompanying drawings.

DESCRIPTION

The preferred embodiment of the present invention shares cross section shape and corrugation characteristics with chambers described in published U.S. patent application No. 20020044833 of Krueger et al., now Pat. No. 7,118,386, and in U.S. patent application Ser. No. 10/402,414 of Krueger et al., filed Mar. 28, 2003, now Pat. No. 7,052,209. Reference may also be made to a commercial product, the SC 310 stormwater chamber (StormTech LLC, Wethersfield, Conn., U.S.). The aforementioned storm chambers are characterized by freedom from ribs. However, because of their different use, storm chambers lack a multiplicity of small perforations in the sidewall, which necessarily characterize leaching chambers and weaken a sidewall. The chamber of the present invention preferably has an end which is shaped for swivel connection, as described in U.S. patent application Ser. No. 10/442,810 of Burnes et al., filed May 20, 2003. The drawings and descriptions of chambers in the foregoing patents, which have some commonality herewith in inventorship and assignee, are hereby incorporated by reference.

During use, a leaching chamber receives relatively small and continuous quantities of high organic-content wastewater, and disperses the water into surrounding soil, so it can be acted on microbiologically. Leaching chambers are typically buried directly in a soil trench, although they may be immediately surrounded by sand or crushed rock. They also may be used to gather liquids from surrounding media. A reference herein to soil, in addition to the common soil of the earth, means any granular water-permeable media into which leaching chambers may be placed for use.

Figure 1:
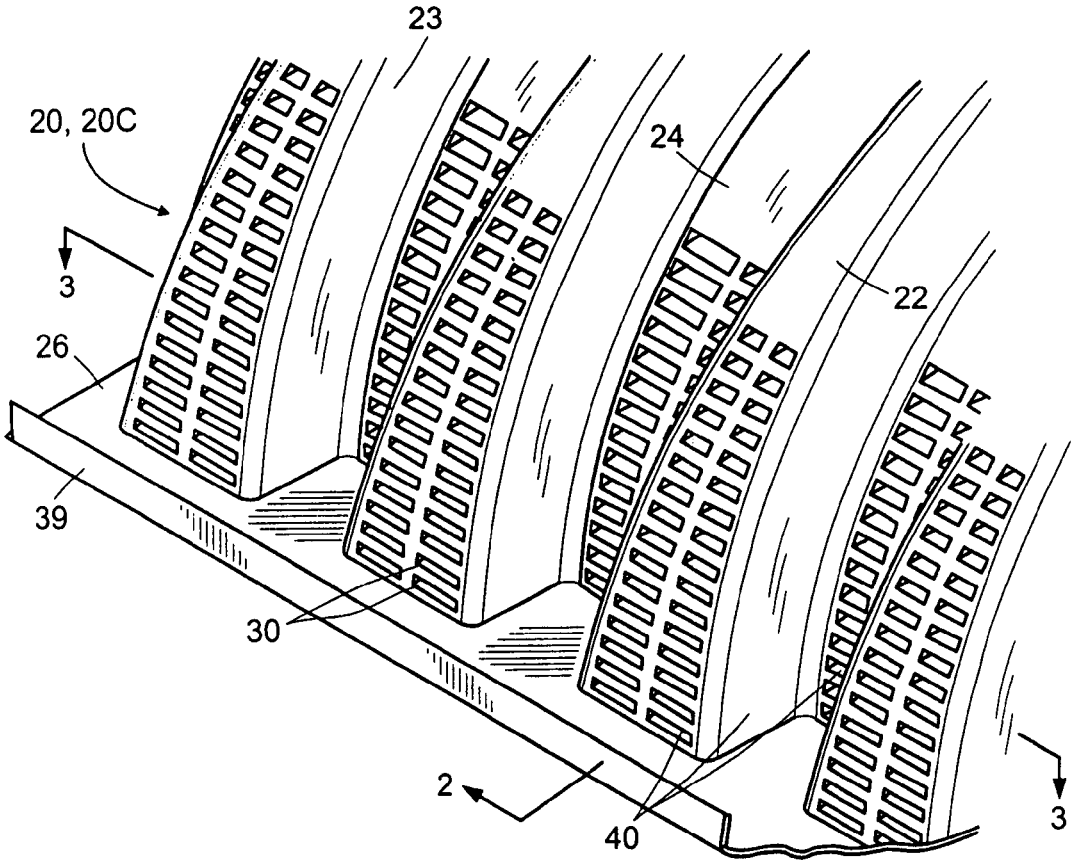
FIG. 1 is an isometric view of a portion of a leaching chamber.
Figure 2:
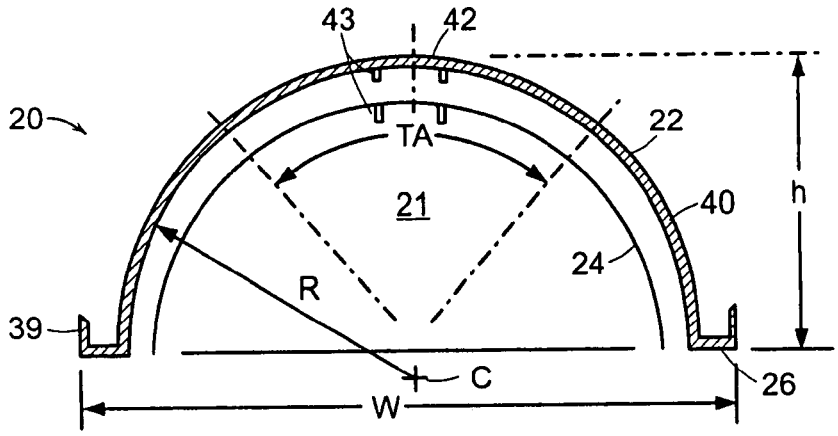
FIG. 2 is vertical plane cross section of the chamber of FIG. 1.

FIG. 1 is an isometric view of a portion of a leaching chamber 20, an embodiment of the present invention. The chamber has horizontal slot perforations 30 in sidewall 40, which are exaggerated in height for better illustration. FIG. 2 is a vertical cross section through chamber 20. The chamber has a continuous curve semi-ellipse arch shape of minor radius R, the pivot point C of which is beneath the plane of the base. Chamber 20 has alternating peaks 22 and congruent valleys 24, which together comprise corrugations running along the arch shape cross section which defines chamber interior 21. Perforations 30 are closely spaced apart along the upward curve of the sidewall 40 at the peak and valley parts thereof. Unperforated webs 23 connect the peaks and valleys.

Figure 3:
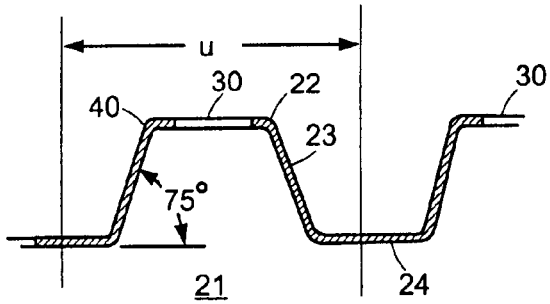
FIG. 3 is a horizontal plane cross section through of a portion of the perforated sidewall of the chamber of FIG. 1.

FIG. 3 is a horizontal plane cross section through a portion of the sidewall of chamber 20. Pitch U of the peaks (valleys)

in the new leaching chamber is less than the pitch of comparable slotted leaching chambers in the prior art. Exemplary chamber 20 has peaks which are pitched, or spaced apart, a distance U of about 6 inches, center to center, which compares with the typical about 12 inch pitch in the prior art. Thus, the number of peaks/valleys per unit length is about doubled, compared to prior art chambers. The closely spaced corrugations, the continuous arch curve cross section and engineered slot perforation pattern combine to provide a lightweight and strong chamber.

Chamber 20 has a height h of about 12 inch, a width w at the base of about 34 inch, and an actual overall length of about 53 inch. When installed, chamber 20 is overlapped by a like chamber at the joint by about 5 inch. Thus the effective length of the chamber, when it is part of a string of chambers is 48 inch. In the trade, the effective length is the nominal length, so chamber 20 is called a 4 ft chamber. The width appellation is likewise nominal; and chamber 20 would be is referred to as a 3 ft wide chamber. At the chamber top, the difference in elevation of the peak and valley is about 2.5 inch. The basic wall thickness of the chamber in unslotted locations is about 0.090 inch. The chamber is injection molded from commercial grade polypropylene, such as Fortilene TG6801 Polypropylene (BP Amoco Co., Naperville, Ill., US.) or other comparable performance material.

Opposing sidewalls 40 rise curvingly up to top 42 from each opposing side base flange 26, which has vertical strengthening fin 39 along its outer edge. Preferably, the whole useful elevation of the sidewall is perforated, at the peaks and at the valleys. When the arch has a continuous curve, such as the semi-ellipse shown in FIG. 2, the point at which the arch surface ceases being sidewall and starts being top is somewhat arbitrary, compared to a planar sided chamber of the prior art, where there is a break or discontinuity in the arch shape of the sidewall at the point where perforations end. In one definition applicable to the invention, the top is that portion of the chamber which lies within angle TA shown in FIG. 2, where TA is about 80 degrees. Alternatively, the top may be considered that part of the chamber which is above the elevation of the invert (i.e., the bottom of the interior opening) of an influent pipe. Typically, that height is determined by the configuration of the endplate and the diameter of the inflow pipe, usually nominally 4 inch. Unless special endplates are used, the maximum invert height for a chamber is usually 4.5 inch below the elevation of a peak corrugation.

The radius of the minor axis of the preferred semi-elliptical arch curve has a point of rotation C, which is just below the plane of the base flange. See said published patent application No. 20020044833 of Krueger et al. The combination of close pitch corrugations, continuous arch shape, and polypropylene material provides chamber 20 with superior specific strength, section modulus, and other specific structural properties, compared to prior art chambers. The arch curve is continuous, from one base flange to the other. For example, the arch shape is nominally a curve selected from the group consisting of a semi-circle, semi-ellipse, and parabola or other surface of revolution. Approximations are contemplated. For instance, sidewall thickness may vary; the sidewall may comprise a multiplicity of small steps or panels, following an essential curve; there may be a small vertical skirt near the base; or there may be a small flat or peaked portion at the top.

Chamber 20 does not have any ribs on the interior or exterior of the corrugated body, which ribs are familiar in prior art chambers. The sidewall may be nominally constant in thickness about a typical perforation, although as described below, there optionally may be relatively small progressive change with elevation. Wall thickness t, is measured perpendicular to the nominal plane of the local wall portion. Basic wall thickness is the nominal wall thickness of the chamber wall, away from perforated areas, for instance, in the web, at the top, and in the base flange. The preponderance of an invention chamber has wall with the basic thickness, which can be visually appreciated from FIG. 15, and from the following data: The preferred embodiment chamber 20, described in more detail below, has a basic wall thickness of about 0.09 inch. The average wall thickness for whole chamber is about 0.098 inch, wherein the perforated sidewall thickness ranges from about 0.15 to about 0.18 inch. Wall thicknesses may be ascertained by direct measurement or by calculation, e.g., dividing the material volume by the surface area of the portion of interest.

In some prior art chambers, louvers are well defined lips above and below the perforations, and that is apparent where they laterally terminate. The sidewall adjacent the perforations will have the basic wall thickness. In other prior art chambers, louvers run into the adjacent sections, for instance into the web, and they are not so visually apparent as louvers. Typically, when viewed in cross section, and with respect to running toward the chamber exterior, the underside of a prior art louver might be horizontal or have a slight upward angle. And, the top side of a louver is down-sloped. Other designs might have both the underside and top sloping downward. The louver opening flares outwardly, reflective of slides which retract into the cavity (female) part of an injection molding die, and desire to have draft on the projections which form the perforations. Typically, prior art louvers define slots which are about 0.5 inch deep, where the basic sidewall elsewhere is about 0.13 inch thick.

Figure 16:
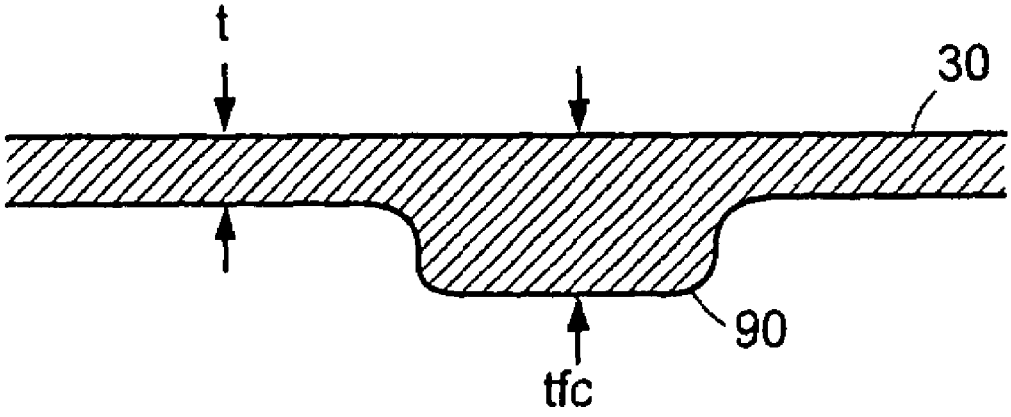
FIG. 16 is a cross section through a chamber wall showing a runner for distributing plastic during injection molding.
Figure 17:
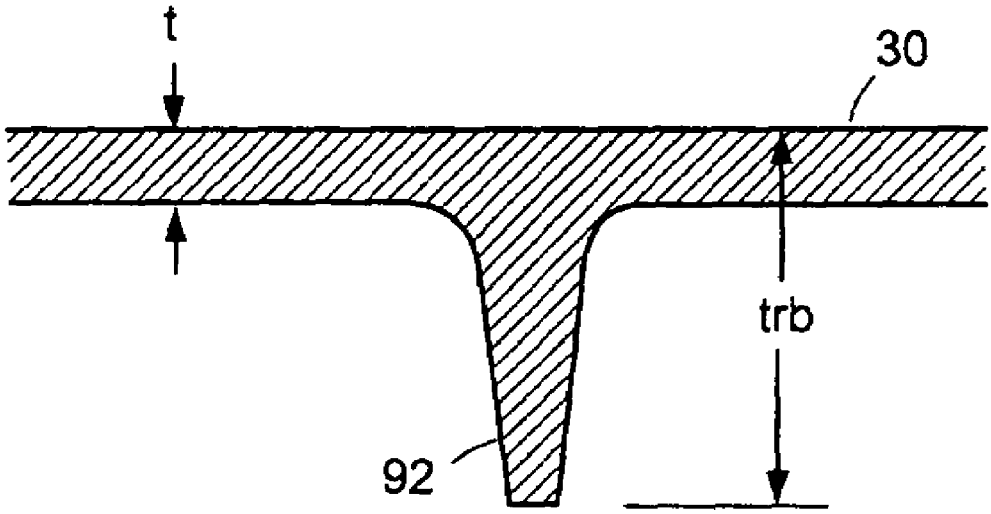
FIG. 17 is like FIG. 16, showing a rib, used for stiffening a chamber wall.

In a preferred chamber of the present invention, sidewall thickness varies from 0.15-0.18 inch, and thus the ratio of perforated sidewall thickness to basic wall thickness 0.09 inch ranges from 1.72 to 1, and averages about 1.85 to 1. The foregoing ratio is called the sidewall thickness ratio. It compares with a ratio of about 4 to 1, characteristic of prior art chambers. Designers of prior art chambers had reasons for the thick sidewall, even though that increased weight and cost. The combination of technology that comprises the present invention achieves substantially lowered sidewall thickness ratios, while still achieving STA which is effective, e.g. 26 degrees The corrugated body portion of chamber 20C, between the ends, has no strengthening ribs as such, but does have runners. Runners, or localized thickened sections of the chamber wall which are also called flow channels, are used as needed, to provide for flow of plastic from injection sprues, which are typically spaced apart near the chamber top. Runners are distinguished from ribs in being relatively squat, as shown in FIG. 16; the thickness (or total height) tfc of a runner 90 is typically about 250 percent of basic wall thickness t. The purpose of the runner is to provide cross sectional area. In contrast, as shown in FIG. 17, a typical rib 92 is tall and thin. The wall thickness trb at the rib is typically 400-500% of the basic wall thickness t, to achieve its intended purpose, which is to provide stiffness, i.e., to substantially increase section modulus with economic use of material. Of course ribs, particularly those with thickened bases, may also serve as flow channels. See aforementioned U.S. Pat. No. 5,716,163 for other examples of such ribs.

In chamber 20C, small drip ledges 43 run in parallel lengthwise along the interior of the top. See FIG. 2. They drop down about 3/16 inch, and are known in the prior art. When pressure-dosed wasterwater is sprayed upwardly into interior of the top, ledges 43 inhibit the water from running down along the sidewalls. Any strengthening from such is incidental. Apart from the rib-free corrugated body portion of the chamber, there are small ribs 45 on the flange 26, running to fin 39. See FIG. 15. The ribs both strengthen the fin and provide support surfaces for an overlying stack of nested chambers.

Figure 4:
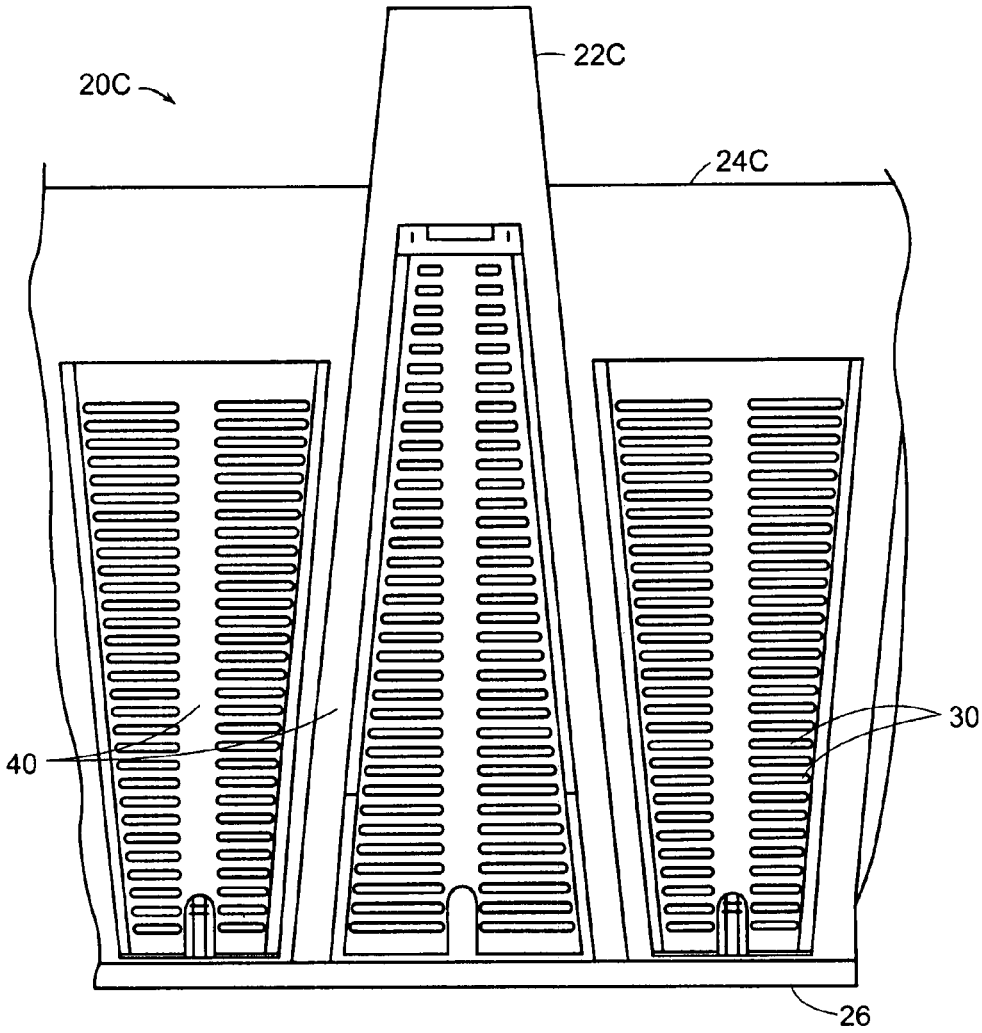
FIG. 4 is an elevation view of a portion of the exterior sidewall of a chamber.
Figure 5:
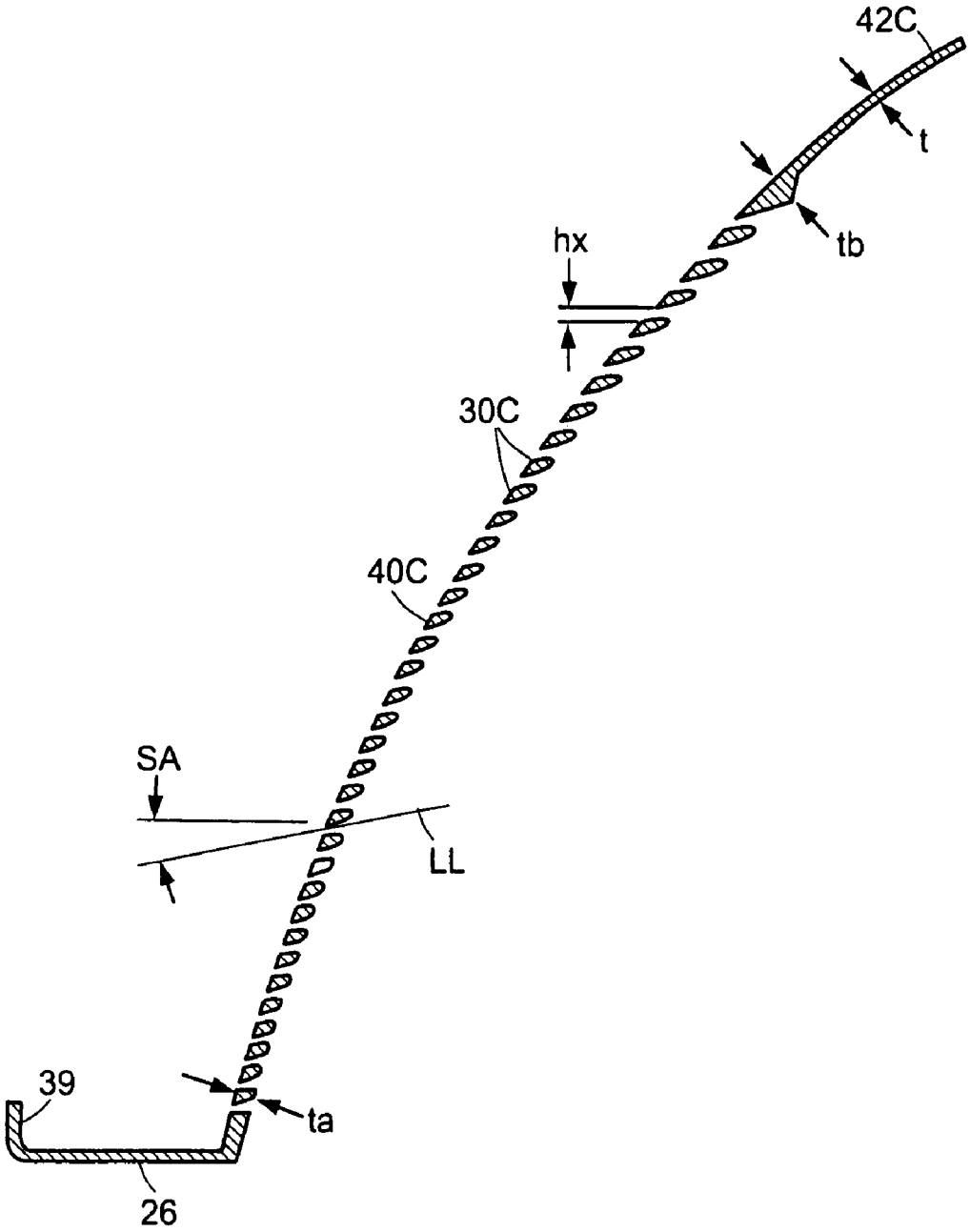
FIG. 5 is a vertical cross section through a portion of sidewall having varying thickness and having inwardly flared slots which increase in height with elevation.
Figure 15:
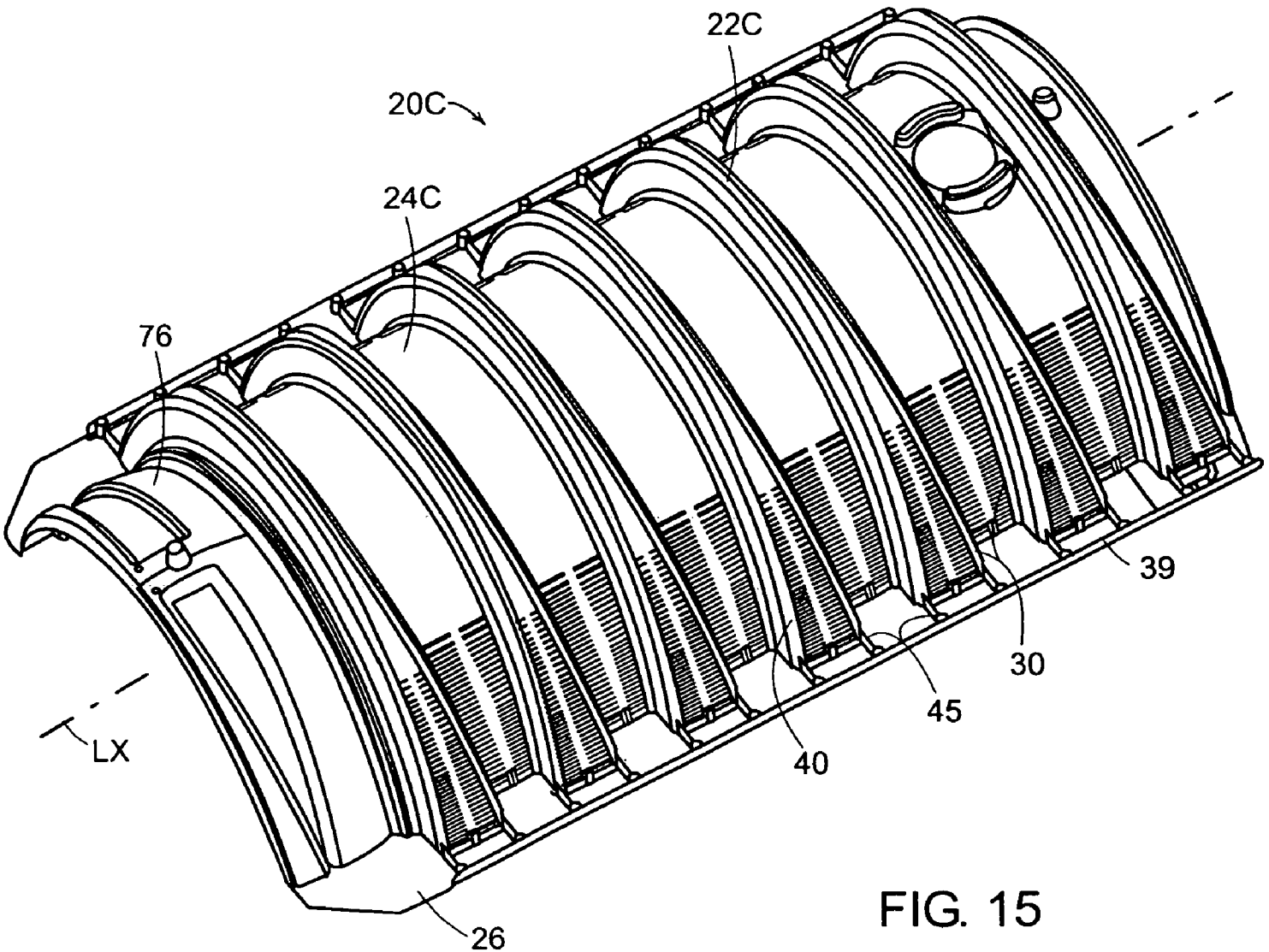
FIG. 15 is an isometric view of a chamber of the present invention.

FIG. 5 is a vertical cross section through a sidewall 40C of a preferred chamber 20C, which is generally like chamber 20. FIG. 4 is side elevation view of the same chamber. See also FIGS. 10 and 11 for details of the slots, discussed further below. Slots 30C, 30 have central axes LL, which slope downwardly at angle SA of about 12 degrees from horizontal. Preferably, the slots are flared inwardly with an about 12 degree included angle, as described further below, and in published U.S. patent application serial No. 20050074286 of Swistak et al., the disclosure of which is hereby incorporated by reference. In chamber 20C, slot height hx (i.e., height h which is measured at the sidewall exterior surface) becomes progressively larger with slot elevation from the base, increasing from about 0.070 inch at the bottom to about 0.090 inch at the top. The vertical edge-to-edge spacing of the slots is about 0.100 inch, measured along the rise or curve of the sidewall. The basic wall thickness t of the chamber away from the perforated wall is about 0.090 inch; and, that is the thickness at the top 42C. In FIG. 5, the thickness of the perforated chamber sidewall increases from ta of about 0.150 inch at the bottom to tb of about 0.175 inch, nominally 0.180 inch, near the top. The preferred design will be further appreciated from the descriptions that follow. FIG. 15 is an isometric view of a whole chamber 20C having features of a preferred embodiment. FIG. 15 illustrates the open ends of the chamber and how they are configured for connecting to other chambers.

Figure 6:
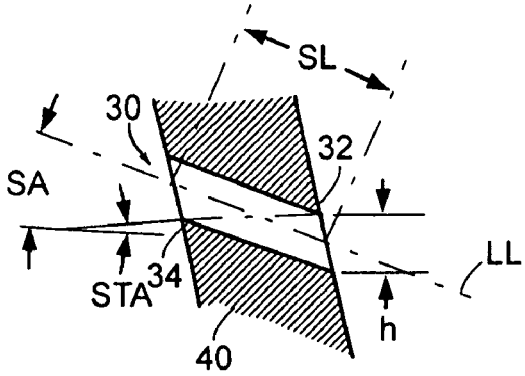
FIG. 6 is a vertical cross section through a sidewall, to illustrate parameters associated with perforations, such as slots.
Figure 7:
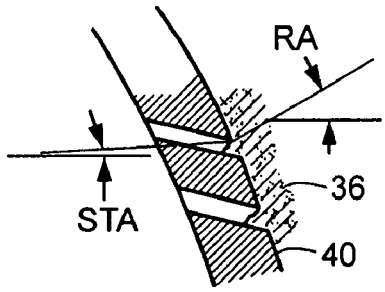
FIG. 7 is like FIG. 6, showing how soil lies within a slot.

FIG. 6 and FIG. 7 are used to define parameters. They show small segments of chamber sidewalls 40 having constant height perforations 30. Perforations 30 slope downwardly, running from the interior to the exterior of the chamber. Perforation 30 has a central axis LL, a depth SL and a height h, measured vertically as indicated in FIG. 6. Perforation length is measured horizontally in the direction of the longitudinal axis LX of the chamber. When the perforation is a slot, it has a width w which is greater than perforation height. Central axis LL of a perforation makes an angle SA with the horizontal plane, i.e., the plane of the bottom of the base of the chamber. A line drawn from the outside top edge 32 of a perforation to the bottom inner edge of the perforation, intersects the horizontal with angle STA. Angle STA, also called Soil Threshold Angle, is a property of a chamber perforation. As further described STA is a function of slope angle SA, slot depth, slot height, and slot flare angle.

FIG. 7 shows how soil 36 lying against the exterior of a chamber wall 40 will tend to enter into the perforation 30 under the influence of gravity and the soil environment, such that the innermost end of the soil lies at an angle RA, also called Angle of Repose. Angle of Repose RA is a property of the soil material, typically measured in the dry state, according to familiar procedures, e.g. pouring material as a pile on a surface. Of course, for a leaching chamber in use, the situation is more complicated, since moisture and organic content affects angle of repose of soil media. Notwithstanding, a practical angle of repose can be determined by measurement of soil angle in a slot under typical field conditions.

Under normal quiescent conditions, soil will theoretically not enter the chamber through perforations if angle STA is less than angle RA. Thus, an angle STA, which is about equal to angle RA, is called the critical STA angle, $STA_c$. For the preferred chambers of the invention, all slotted perforations have angle STA which is equal or less than $STA_c$. From a certain sanitary engineering and regulatory viewpoint, the useful leaching area of a chamber is based on the soil which is exposed in the slot, namely that lying along the slope of the angle RA or angle STA, as may be attributed to be the limiting case. Leaching area for a chamber sidewall, is often based on the soil which lies along angle STA. (An alternate way is to calculate the total of perforation opening area; and for many prior art chambers the two modes don't vary greatly. Total leaching area for a chamber typically includes the area at the base of the arch.) STA angle for a chamber will typically be set according to the designer's estimation of field conditions, experience, and the aims for the product in the marketplace. In the invention STA is preferably less than 30 degrees, and in the range of 20-30 degrees. More preferably, STA is about 26 degrees or less.

Chamber perforations are preferably horizontal slots, wherein the opening at the exterior surface of the sidewall is rectangular. Perforations having other shape openings, such as square, round or elliptical may be used in the generality of the invention. Perforation height as defined in the invention has been shown in the illustrations; and, it will be measured in accord with good meteorological practice. Generally, the slot height of interest in leaching chambers is the vertical plane slot height hx measured at the outside of the chamber sidewall. The number and size of perforations on a sidewall, the spacing, and perforated sidewall thickness, will be a function of material properties, the loads that the chamber is designed to withstand, including loads carried by the perforated sidewall ligaments due to downward arch loads and lateral force from surrounding of soil, and other structural design factors.

Figure 8:
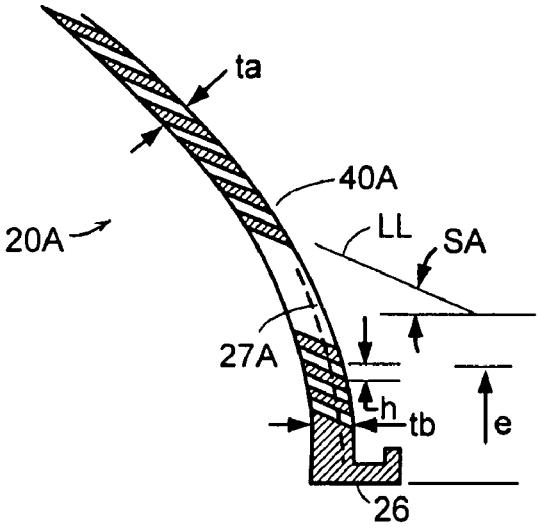
FIG. 8 is a vertical cross section through a portion of chamber sidewall having constant slot perforation height and wall thickness which decreases with elevation.
Figure 9:
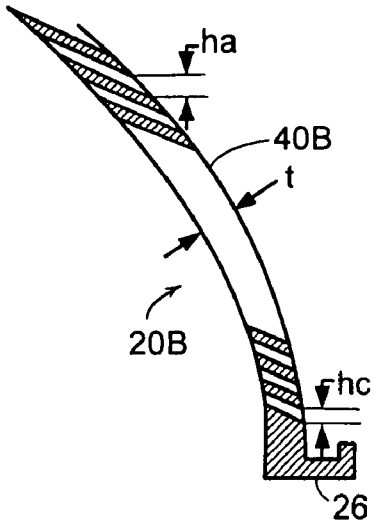
FIG. 9 is a vertical cross section through a portion of chamber sidewall having constant wall thickness and slot perforation height which increases with elevation.

FIGS. 8 and 9 show portions of the sidewalls of two alternative embodiments of the invention. In each, the basic axes LL of downward sloping, essentially constant height, slots run at an angle SA, for example 12 degrees. In FIG. 8, chamber 20A has a curved sidewall 40A, with a plurality of upwardly spaced apart slots, all having the same height dimension h and angle SA. Sidewall 40A progressively decreases in thickness t with elevation e; from tb at the lower part of the sidewall to ta at the upper part. For comparison, phantom line 27A superimposes a constant thickness sidewall. If the sidewall 40A had such constant thickness, STA for slots at the lower part of the sidewall would be substantially greater than STA for slots at the upper part. Thus, the effect of thickening the lower wall of chamber 20A is to decrease angle STA, preferably so STA for all perforations is less than or equal to $STA_c$. In another way of characterizing this aspect of the invention, sidewall thickness is increased at more nearly vertical portions of the sidewall, i.e., the lower portions, to raise STA.

In the chamber 20B embodiment, shown in FIG. 9, thickness t of sidewall 40B is constant. The height h of the perforations is progressively increased with elevation, from small hc near the base to larger ha at the upper part of the sidewall. The decrease in height of the lower elevation perforations compensates for the decreased perforation depth, so that the desired STA is achieved.

Thus, in the generality of the invention, sidewall thickness is changed and or perforation height is changed with elevation of the perforation, to control (lower) STA, preferably so all perforations have STA equal or less than $STA_c$. Wall thickness may be varied in step function manner, to approximate a continuously varying thickness sidewall. Perforation height may likewise be varied in an incremental or step-function manner. The principles of the invention can be applied to chambers which have perforated sidewalls which may not be continuously curved, but which sidewalls have different slopes at different elevations. For example, a chamber may have a sidewall comprised of two or more planar sections, one above the other, or one adjacent the other. Similarly, the invention may be applied to only a portion of the vertical elevation of a sidewall, with the rest of the sidewall having different perforation features.

Figure 10:
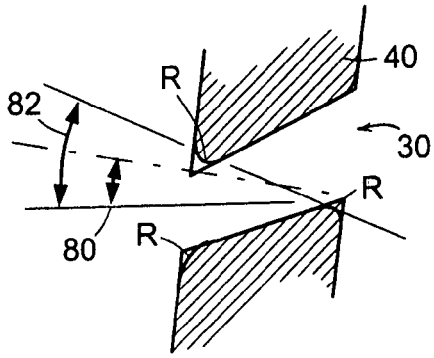
FIG. 10 is a vertical cross section through the sidewall, to show the effect of rounding of the edges of the slot entry and exit on Soil Threshold Angle STA.

STA as defined and shown in drawings thus far assumes that the sidewall interior and exterior surfaces are perfectly formed, and the perforation edges are sharp edges. In practical parts, the sharp interior and exterior edges of the slots or other perforations are usually not present, either by design or because of manufacturing limitations. Typically, there will be a radius R or rounding on the edges, as shown in FIG. 10. For instance, in a chamber 20C, the upper and lower edges of the slots may have a radius of 0.010-0.030 inch, preferably about 0.0.020 inch. As illustrated in FIG. 10, perfect or unrounded edges will produce a perfect or theoretical STA 80. When the edges have radii, a greater STA 82 results. The effect is more significant at the upper perforations. So, the chamber designer takes the edge radius effect into account when determining how wall thickness or slot height should vary. Thus, in chamber 20C, the perforated sidewall is thickened where it approaches top 42C, because the favorable effect on STA of the less vertical sidewall at such location is insufficient to achieve the desired STA.

Referring again to chamber 20C and FIGS. 4 and 5, to seek to optimize design with respect to chamber strength, leaching area and material utilization, and to obtain essentially constant STA of about 26 degrees, slot height hx is decreased for slots at the lower portion of the sidewall, compared to slots at the upper portion. To compensate for the edge radius effect, sidewall 40C is about 0.025 inch (or about 20%) thicker at the upper elevation that it is near the base. In the absence of an about 0.020 inch edge radius, the STA at the top slot would be about 16 degrees instead of the desired 26 degrees which is obtained.

In another variation, not pictured, chamber 20C is modified so that the slot height does not vary substantially from the lowermost slot height, irrespective of slot elevation. That would have the effect of reducing chamber leaching area somewhat. In another variation, also not pictured, the slots of chamber 20C are configured with varied height as first described, and the sidewall has a constant thickness tb, characteristic of the upper sidewall. That which would mean that the lower part of the sidewall would be stronger than needed, but excessive in thickness from the standpoint of minimum STA.

Chambers in the present invention may have perforations which are essentially straight, which flare outwardly, or preferably, which flare inwardly. While in general perforations can be formed by machining, laser cutting, and possible other techniques, slots in prior art molded chambers have been predominately formed by molds having movable slide parts, typically located in the cavity part of the mold. Such slides move horizontally or at a downward angle, usually along the basic axis LL of the perforations, according to the particular maker. Even when slots or other perforations are intended to be straight, typically they will have a small flare or draft, for example 2 degrees or more. In other instances, flaring may be greater, for example, up to 12 degrees included angle.

Figure 11:
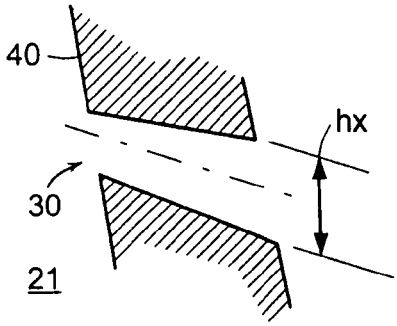
FIG. 11 is a view like FIG. 10, showing a slot which flares outwardly.
Figure 12:
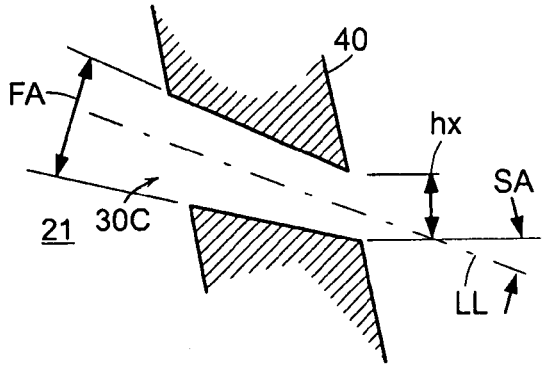
FIG. 12 is a view like FIG. 10, showing a slot which flares inwardly.

FIG. 11 shows a typical slot 30 for which height h changes with slot depth (which also may be called the through-wall length), so the slot flares outwardly toward the chamber exterior. FIG. 12 shows preferred typical slot 30 which flares inwardly toward the chamber interior 21, so the minimum height h of the slot, namely hx, is at the exterior surface. The downward slope angle SA is preferably 12 degrees; and, the included angle FA of the flare is preferably about 12 degrees. Chambers having slots 30 are formed by molds which have slides that retract into the core portion of the mold, that is, inwardly from the sidewall exterior, as detailed in the aforementioned published U.S. patent application serial No. 20050074286 of Swistak et al. The slots of preferred embodiment chamber 20C are shaped like those in FIG. 11. In the generality of the present invention, the other configurations of slots which have been described may be used.

The combination of curved arch shape, chamber corrugations, varied wall thickness and slot height, and material strength, enables the preferred chamber of the invention to be made free of substantial strengthening ribs which have characterized the chambers of the prior art, to provide strength. The chambers are thus lighter in weight than chambers in the prior art, and stack more compactly.

Table 1 compares the invention chamber with a prior art same-company product for which it may substitute. The weight per linear foot of the new chamber is about 35% less than the comparable product. It has a leaching area per pound of chamber weight is about 35% greater, showing much greater efficacy of material utilization. Lighter weight and thinner wall chambers use less material and can be made with a quicker injection mold time cycle, thus achieving certain objects of the invention.

TABLE 1

Comparative nominal properties of certain leaching chambers.

| Property | Prior Art Infiltrator Chamber Standard | Invention Chamber 20 C. |
|---|---|---|
| nominal length -inch | 75 | 48 |
| actual length - inch | 76.5 | 53 |
| width - inch | 34 | 34 |
| total height - inch | 12 | 12 |
| invert height - inch | 7 | 8 |
| weight - lb | 27 | 11.5 |
| weight per length - lb/ft | 4.4 | 2.9 |
| Leaching area - sq inch | 2460 | 1430 |
| Leach area/weight - sq inch/lb | 90 | 124 |
| Leach area/length - sq inch/inch | 33 | 30 |
| Volume/length - cu ft/ft | 1.7 | 1.5 |

Table 2 compares various parameters of the preferred invention chamber 20C of FIG. 15 with comparable arch shape slotted wall commercial chambers No. 1-9, in the prior art. The class of compared chambers is intended for burial in a nominal 36 inch wide trench, with soil or other media directly in contact with the sidewall, i.e., without a layer of geotextile filter fabric.

TABLE 2

Comparative properties of slotted wall leaching chambers.

| | | Length (in) | Width (in) | LA (Leaching area) ($ft^2$) | Weight lbs | Weight/ FT lbs/ft | LA/lb $in^2$/lb |
|---|---|---|---|---|---|---|---|
| Invention | | 48 | 34 | 9.9 | 11.5 | 2.9 | 124 |
| 1 | ISTD | 75 | 34 | 17.1 | 27.5 | 4.4 | 90 |
| 2 | IHC | 75 | 34 | 17.6 | 35 | 5.6 | 72 |
| 3 | ISW | 75 | 34 | 16.7 | 29 | 4.6 | 83 |
| 4 | ISWHC | 75 | 34 | 18.3 | 36 | 5.8 | 73 |
| 5 | HE | 75 | 34 | 17.2 | 35 | 5.6 | 71 |
| 6 | HEHC | 75 | 34 | 20.5 | 40 | 6.4 | 74 |
| 7 | BDLP | 76 | 34 | 16.8 | 27.4 | 4.3 | 88 |
| 8 | BD14 | 76 | 34 | 18.7 | 35.5 | 5.6 | 76 |
| 9 | BD16 | 74 | 33 | 18.6 | 34.3 | 55 | 78. |

Chambers of the invention and prior art are made of high density polyethylene or polypropylene, or combinations of other thermoplastics, which typically which have density in the range of 0.033-0.034 lb per cu inch. The prior art chambers No. 1-9 are largely alike, with widths, measured at the base of nominally 34 inch. Other prior art chambers, for specialized uses, not shown in the Table, are narrower and longer, and are not considered comparable in the present analysis. Chambers 1-4 are Infiltrator brand chambers, made by gas-assisted injection molding, which hollows many of the rib bases and runners provides reduced weight per unit length and greater leaching area per unit weight of thermoplastic material.

The lengths of the comparable prior art chambers are all around 75 inch, while the invention chamber is preferably about 48 inch. (See prior discussion about actual versus nominal length.) The short length chamber is surprisingly easier to handle and install, economic to make, and provides better ability of a string of interconnected chambers to deviate from the straight line. Nonetheless, in the generality of the present invention, chambers may be made any length. The Table 2 data discussed below are normalized for length.

Figure 13:
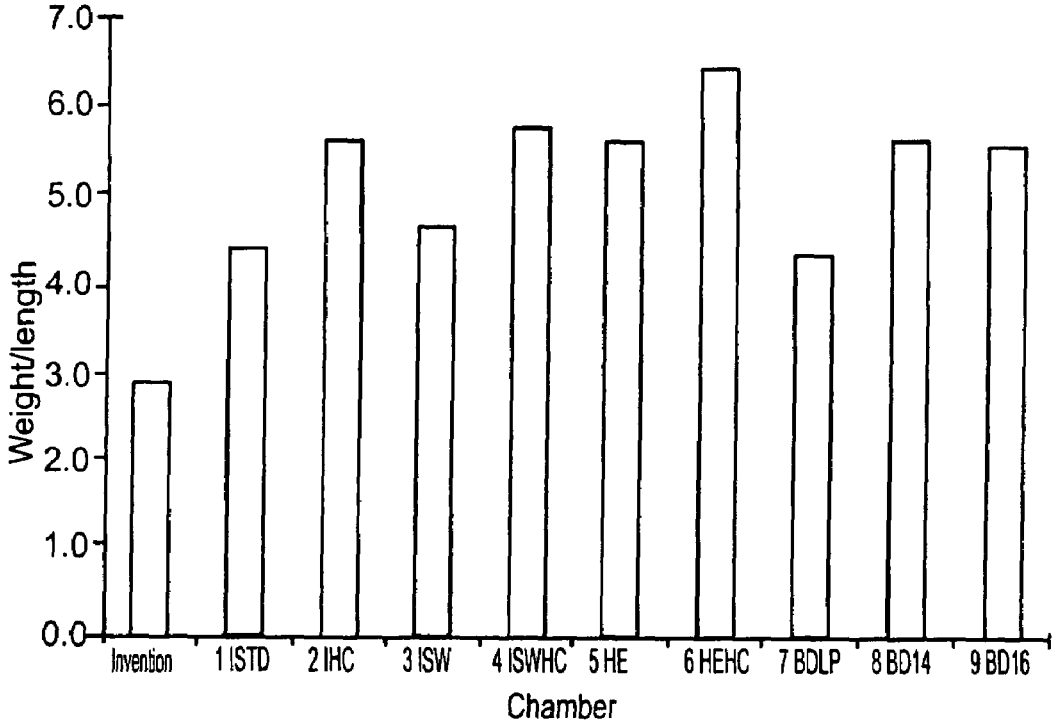
FIG. 13 is a bar graph, showing how chambers compare with respect to weight per linear foot.
Figure 14:
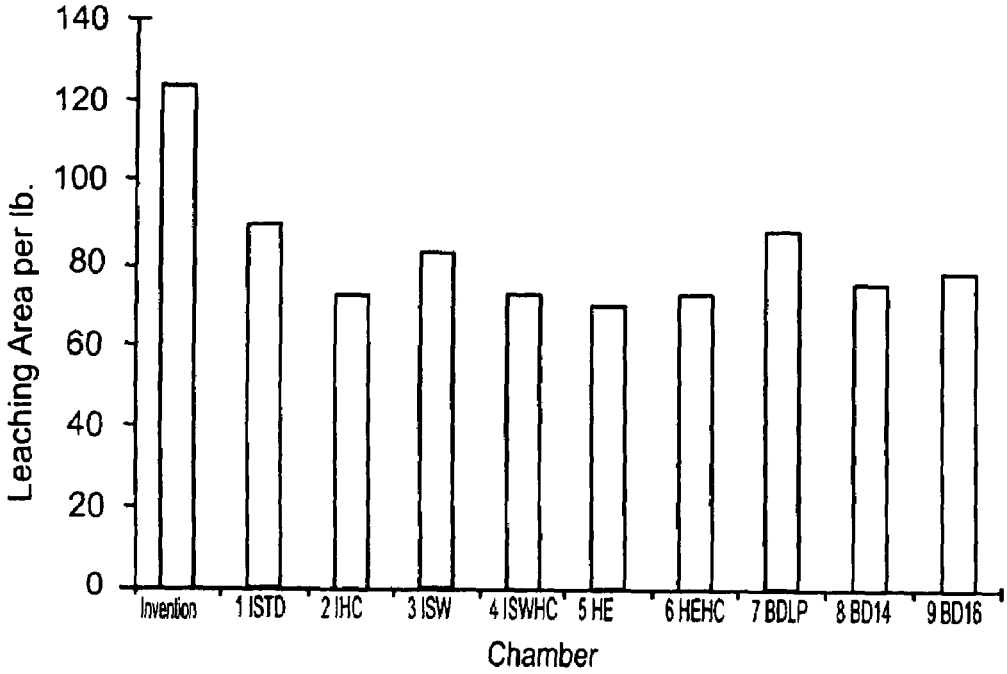
FIG. 14 is a bar graph, showing how chambers compare with respect to leaching area per unit weight.

The invention chamber has properties which are substantially different from the chambers of the prior art, due to the unique design features of the invention. FIGS. 13 and 14 portray some of the Table 2 data in bar chart fashion. FIG. 13 illustrates how the weight per foot of length of the invention is about 3 lb/ft, substantially less than the nominal 4-6 lb/ft value in the prior art. FIG. 14 illustrates how the ratio of leaching area to weight is at about 120 sq inch/lb, substantially greater than the nominal 70-90 sq inch/lb characteristic of the prior art. Thus, there is much improved material utilization. (Leaching area is a calculated measure of useful surface area of soil, including that at the bottom of the arch shape cross section, which is exposed to wastewater during use). For Table 2, leaching area is based on the inside surface or outside surface perforation opening area, whichever is smaller for the particular chamber. Referring again to Table 1, preferred chamber 20C has a volumetric (wastewater) capacity of about 1.5 cu ft (about 11 gallon) per ft of length, which is in the same range of the about 1.6 cu ft (about 12.5 gallon) capacity of the comparison chamber. The moderate inferiority of the invention in this respect is greatly outweighed by the other advantages, which have been described. And, due largely to the absence of ribbing, the invention chambers are adapted to nest well, with a stacking height of about 0.9 inch per chamber. Therefore, shipping is economical.

Obviously, for any embodiment that has been described, chamber wall may be thickened overall from what has been described as preferred, even though that would decrease the degree of advantage of the invention over the prior art. And, the end details, which are relatively compact and which do not add much weight, could be made more complex. So, taking these factors into consideration, a chamber of the present invention may have greater wall thickness and weight than the preferred embodiment chamber 20C of Table 2, while attaining a leaching area to weight ratio of greater than about 120 sq inch per pound and a weight per linear foot of less than about 4 lb/ft.

Despite the absence of ribs and the reduced amount of material, chambers 20, 20C will have comparable strength to prior art chambers. For example, the normalized section modulus of segment of the chamber top, relative to a lengthwise centroid axis, is about 0.18 $inch^3$ per inch of chamber length which is not much different from about 0.20 $inch^3$ section modulus of a ribbed ISI Hi Cap chamber. Section modulus is a measure of the ability of the structure to resist bending loads. The respective new and old chamber moment of inertia values are between about 0.13 and about 0.18 $inch^4$ per inch of chamber length. When installed and covered with about 12 inch of compacted soil, the invention chamber is comparable in performance to the ISI Hi Cap chamber, when subjected to a vertical load from a vehicle axle bearing 16,000 lb, when tested to meet an H-10 rating of American Association of State Highway and Transport Officials (AASHTO), when tested according to procedures published by International Association of Plumbing and Mechanical Officials (IAPMO).

Although this invention has been shown and described with respect to one or more preferred embodiments, and by examples, those should not be considered as limiting the claims, since it will be understood by those skilled in this art that various changes in form and detail thereof may be made without departing from the spirit and scope of the claimed invention.

We claim:

1. An arch shape cross section corrugated leaching chamber having a base, a top, and opposing sidewalls running upwardly from the base to the top, the sidewalls extending horizontally along the chamber length, which comprises: a sidewall portion running curvingly upward and inward toward the top of the chamber, the portion having a thickness and a plurality slots extending lengthwise horizontally and spaced apart upwardly alone the sidewall portion, for flowing water from within the interior of the chamber to the exterior of the chamber through the thickness of the sidewall portion in a direction which transverse to said length; each slot having an opening height proximate the exterior surface of the sidewall portion, which height is the vertical spacing between the horizontally-extending surfaces which define the slot; wherein the thickness of the upper end of said sidewall portion which is furthest from the base of the chamber is less than the thickness than the lower end of said sidewall portion which is nearest to the base of the chamber.

2. The chamber of claim 1 wherein all of the plurality of slots have substantially the same opening height.

3. The chamber of claim 1 wherein said sidewall portion thickness decreases progressively with increasing elevation.

4. The chamber of claim 1, wherein said portion of sidewall comprises the substantial entirety of the slotted portion one of said opposing sidewalls.

5. The chamber of claim 2, wherein said portion of sidewall comprises the substantial entirety of the slotted portion one of said opposing sidewalls.

6. The chamber of claim 3, wherein said portion comprises the substantial entirety of one of said opposing sidewalls.

7. The chamber of claim 1, wherein said sidewall portion slots are outward flaring slots.

8. The chamber of claim 1 wherein said sidewall portion slots are inward flaring slots.

9. The chamber of claim 1 wherein the each of the slots in said sidewall portion has a downward sloping central axis.

10. The chamber of claim 1 wherein the Soil Threshold Angles (STA) of said plurality of slots are substantially similar; wherein Soil Threshold Angle is the angle between a horizontal line and a straight line running from the top outside edge of a slot to the bottom inside edge of the slot.

11. The chamber of claim 10 wherein the Soil Threshold Angles (STA) are less than about 30 degrees.

12. The chamber of claim 10 wherein the Soil Threshold Angles (STA) are less than about 26 degrees.

13. The chamber of claim 1 wherein slot opening heights increase progressively with increasing elevation.

14. The chamber of claim 1 wherein all the slots of said plurality each have a central axis which runs at substantially the same angle (SA) to the horizontal plane of the base of the chamber.

15. The chamber of claim 1, wherein the basic wall thickness of the chamber is about 0.1 inch or less.

16. The chamber of claim 1 wherein the chamber has corrugations which comprise adjacent peaks and valleys running across the arch of the chamber cross section; and wherein the pitch or spacing between adjacent peaks is between 6 and 8 inches.

17. An arch shape cross section leaching chamber made of molded thermoplastic comprising: a base; a top; and, opposing sidewalls running upwardly from the base to the top, the sidewalls extending lengthwise along the chamber; each sidewall having portions which run curvingly inwardly and upwardly toward the top; said portions having horizontally-extending slots spaced apart upwardly along the sidewall portion for flowing water outwardly through said sidewalls in a direction which is transverse to the length of the chamber; wherein the slots of said portion have substantially equal opening heights proximate at the exterior surface of the sidewall, wherein slot opening height is the vertical distance between the horizontally-extending surfaces which define the slot; and, wherein the thickness of said sidewall portion varies progressively with elevation from the base where the sidewall is perforated.

18. The chamber of claim 17 wherein the average wall thickness for all the slotted portions of the sidewalls is less than about 2.5 times the average wall thickness of the unslotted other portions of the chamber.

19. The chamber of claim 17, wherein substantially all the slots have substantially the same Soil Threshold Angle (STA), wherein Soil Threshold Angle is the angle between a horizontal line and a straight line running from the top outside edge of a slot at the exterior of the chamber to the bottom inside edge of the slot at the inside of the chamber.

20. A method for constructing a portion of the sidewall of an arch shape cross section leaching chamber, wherein the chamber has a base, a top, and opposing sidewalls running upwardly from the base to the top, which comprises: (a) forming a portion of the sidewall to run curvingly upwardly and inwardly from the base toward the top of the chamber, so that the sidewall has a thickness which varies with elevation from the base of the chamber; and, (b) forming a plurality of upwardly spaced apart horizontal slots in said sidewall portion, wherein each slot has an opening height which is the vertical distance between the horizontally-extending surfaces which define the slot at the exterior surface of a sidewall; so that each slot has a Soil Threshold Angle (STA) which is substantially equal to a predetermined value, wherein Soil Threshold Angle is the angle between a horizontal line and a straight line running from the top outside edge of a slot to the bottom inside edge of the slot.

21. The method of claim 20, wherein said predetermined value of Soil Threshold Angle (STA) is 30 degrees.

22. The method of claim 20, further comprising: (c) keeping constant the said opening heights of said slots.

* * * * *

UNITED STATES PATENT AND TRADEMARK OFFICE

CERTIFICATE OF CORRECTION

PATENT NO. : 7,396,188 B2
APPLICATION NO. : 11/717551
DATED : July 8, 2008
INVENTOR(S) : Ronald P. Brochu et al.

It is certified that error appears in the above-identified patent and that said Letters Patent is hereby corrected as shown below:

Claim 1, line 8, change “alone” to --along--

Claim 1, line 11, after “which” insert --is--

Claim 1, line 17, change “than” to --of--

Claim 4, line 2, after “portion” insert --of--

Claim 5, line 2, after “portion” insert --of--

Claim 17, line 11, delete “at”

Signed and Sealed this

Second Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,396,188 B2
APPLICATION NO. : 11/717551
DATED : July 8, 2008
INVENTOR(S) : Ronald P. Brochu et al.

It is certified that error appears in the above-identified patent and that said Letters Patent is hereby corrected as shown below:

Column 12, Claim 1, line 27, change “alone” to --along--

Column 12, Claim 1, line 30, after “which” insert --is--

Column 12, Claim 1, line 36, change “than” to --of--

Column 12, Claim 4, line 43, after “portion” insert --of--

Column 12, Claim 5, line 46, after “portion” insert --of--

Column 13, Claim 17, line 23, delete “at”

This certificate supersedes the Certificate of Correction issued September 2, 2008.

Signed and Sealed this

Thirtieth Day of September, 2008

JON W. DUDAS
*Director of the United States Patent and Trademark Office*